US007967187B2

(12) United States Patent
Yukumoto et al.

(10) Patent No.: US 7,967,187 B2
(45) Date of Patent: Jun. 28, 2011

(54) EASILY UNSEALABLE PACKAGING BODY AND METHOD OF MANUFACTURING THE SAME

(75) Inventors: Tohru Yukumoto, Chiba (JP); Hiroyuki Takahashi, Chiba (JP)

(73) Assignee: Idemitsu Unitech Co., Ltd., Tokyo (JP)

( * ) Notice: Subject to any disclaimer, the term of this patent is extended or adjusted under 35 U.S.C. 154(b) by 583 days.

(21) Appl. No.: 10/546,871

(22) PCT Filed: Feb. 24, 2004

(86) PCT No.: PCT/JP2004/002137

§ 371 (c)(1),
(2), (4) Date: Aug. 25, 2005

(87) PCT Pub. No.: WO2004/076311

PCT Pub. Date: Sep. 10, 2004

(65) Prior Publication Data

US 2006/0175387 A1 Aug. 10, 2006

(30) Foreign Application Priority Data

Feb. 26, 2003 (JP) ..... 2003-049682

(51) Int. Cl.
*B65D 43/02* (2006.01)
*B65D 43/14* (2006.01)

(52) U.S. Cl. ..... 229/123.1; 53/478; 53/467; 220/359.1

(58) Field of Classification Search ..... 229/123.1, 229/125.35, 245; 220/359.1, 359.3, 359.2, 220/359.4; 53/485
See application file for complete search history.

(56) References Cited

U.S. PATENT DOCUMENTS 3,101,870 A * 8/1963 Betner ..... 222/153.07
4,215,797 A * 8/1980 Chen ..... 220/359.4
4,865,217 A * 9/1989 Yoshimoto ..... 220/266
4,915,289 A * 4/1990 Hatano et al. ..... 229/123.1
4,961,513 A * 10/1990 Gossedge et al. ..... 220/276
5,098,751 A * 3/1992 Tamura et al. ..... 428/35.8
5,167,339 A * 12/1992 Takata et al. ..... 220/270

(Continued)

FOREIGN PATENT DOCUMENTS

EP 0 349 009 A2 1/1990

(Continued)

*Primary Examiner* — Nathan J Newhouse
*Assistant Examiner* — Christopher Demeree
(74) *Attorney, Agent, or Firm* — Oblon, Spivak, McClelland, Maier & Neustadt, L.L.P.

(57) ABSTRACT

An easy-open packaging body 1 includes: a container body 10 with a flange 14 formed on a circumference of an opening 13, and a cover 20 heat-sealed to the flange 14 to close the opening 13. Inner and outer notches 15A and 15B enclosing the opening 13 are formed respectively on inner and outer circumferential sides on the flange 14. The flange 14 and the cover 20 are heat-sealed by a first seal part 16A having a predetermined width and formed between the inner and outer notches 15A and 15B to enclose the opening 13 and a second seal part 16B having a width narrower than that of the first seal part 16A and formed within an area of the first seal part 16A to enclose the opening 13 along the first seal part 16A, the second seal part 16B having a projected seal part 17 projected outward relative to the other part on a position corresponding to a tab 21.

13 Claims, 2 Drawing Sheets

U.S. PATENT DOCUMENTS

| | | | | |
|---|---|---|---|---|
| 5,178,293 | A * | 1/1993 | Suzuki et al. | 220/359.3 |
| 5,752,614 | A * | 5/1998 | Nelson et al. | 220/276 |

FOREIGN PATENT DOCUMENTS

| | | |
|---|---|---|
| EP | 0 403 393 A1 | 12/1990 |
| JP | 61-244703 | 10/1986 |
| JP | 2-269675 | 11/1990 |
| JP | 4-57760 | 2/1992 |
| JP | 2001-10658 | 1/2001 |
| JP | 2003-54634 | 2/2003 |
| JP | 2003-226365 | 8/2003 |
| JP | 2003-312732 | 11/2003 |

* cited by examiner

EASILY UNSEALABLE PACKAGING BODY AND METHOD OF MANUFACTURING THE SAME

TECHNICAL FIELD

The present invention relates to an easy-open packaging body and a manufacturing method of the same.

BACKGROUND ART

For a packaging body formed by filling a container with contents such as food and heat-sealing a cover to the container, high sealing performance is desired in terms of keeping quality of the contents, which requires sealing with high heat-sealing strength. On the other hand, in terms of usability in using the contents, the packaging body should preferably be opened with small force, in other words, easy-open performance is desired. Various methods have been suggested for satisfying the sealing performance and easy-open performance as contradictory performances.

Especially, there have been suggested a method for adjusting adhesive strength of a heat-sealed interface by controlling heat-sealing condition in sealing a container by heat-sealing a flange extending from an opening of the container in an outer circumferential direction and a cover, and a method for forming a container such that at least an innermost layer of the container is peeled off with a cover when the cover is opened.

In terms of securing rigidity of the container to meet size increase, shape change, and thickness reduction of the container for resource saving, it has been suggested increasing the width of a flange of the container, providing a flange with a skirt having a bent part that is formed by bending an outer circumferential end of the flange; providing a flange with a curl formed by bending an outer circumferential end of the flange to have a substantially C-shaped cross section.

In the container with the uniquely-shaped flange having the skirt or the curl, when the flange of the container and the cover are heat-sealed, it is required to peel off the innermost layer of the container with the cover while leaving a part other than a heat-sealed part of the flange. Thus, it might become even more difficult to realize the easy-open performance while keeping the sealing performance.

In order to solve the problem, a new easy-open container has been suggested (see, for instance, Japanese Patent Publication No. 2724355, left column of page 3 and FIG. 1).

In the disclosed technique, ringed inner and outer notches are respectively provided on the inner and outer circumferential sides of a flange to enclose an opening of the container, and a melt-seal part is formed between the inner and the outer notches so that the flange and the cover adhere to each other. A projected seal part projected outward relative to the outer notch is formed on the melt-seal part on a position corresponding to a tab of the cover. A dent is formed on an inner layer of the container positioned on an outer edge of the projected seal part. In the easy-open container, when the cover is peeled off from the container, the dent formed on the outer edge of the projected seal part serves as a trigger of the peeling, and subsequently, the cover is gradually peeled off along the outer notch.

However in the technique described above, when the contents of the container are food, the contents are contained and then boiled or heated for sterilization after forming the container and the notches. Since positions of the notches are slightly displaced due to the heating, a heat-seal position cannot be placed between the two notches and the heat-sealing is provided on an area out of the notches, which causes problem in sealing performance of the container. If, for instance, adhesive strength between the cover and the container is increased to solve the problem of the sealing performance, then peeling with small force becomes difficult, so that the easy-open performance cannot be realized. As a result, both of the sealing performance and the easy-open performance cannot be achieved at the same time.

In addition, in forming the dent on the outer edge of the projected seal part, a dent is formed on a position other than the predetermined position described above, which causes the peeling to start from the outer circumferential end of the heat-sealed part instead of from the outer notch, so that it is difficult to manufacture the container with consistent quality.

DISCLOSURE OF THE INVENTION

An object of the present invention is to provide an easy-open packaging body satisfying both of sealing performance and easy-open performance with consistent quality and a manufacturing method of the same.

An easy-open packaging body according to an aspect of the present invention formed by molding a multilayer sheet, includes: a container body including an opening and a flange formed on a circumference of the opening; and a cover that is heat-sealed to the flange to close the opening, the cover having an open trigger formed on an outer circumference thereof: when the cover is peeled off from the open trigger, at least an innermost layer of the container body which is heat-sealed on the flange is peeled off with the cover in opening; an inner notch and an outer notch each enclosing the opening are formed respectively on an inner circumferential side and an outer circumferential side of the flange; the flange and the cover are heat-sealed by a first seal part having a predetermined width and formed between the inner notch and the outer notch and a second seal part having a width narrower than that of the first seal part and formed within an area of the first seal part to enclose the opening along the first seal part; and the second seal part has a projected part projected outward relative to the other part thereof at a position corresponding to the open trigger.

Herein, in order to peel off at least the innermost layer of the flange of the container together with the cover, the peeling strength should be 4 to 15 N/15 mm, more preferably, 8 to 12 N/15 mm. The sealing strength between the flange of the container and the cover should be equal to or higher than 23 N/15 mm.

The shape of the projected part is not limited specifically, and triangular, trapezoidal, quadrangular and semicircular shapes can be exemplified.

The shape and size of a tip end and a base end of the projected part are not limited specifically either, but the base end is preferably rounded in the outer circumferential direction.

Further, the number of the projected part is not limited either as long as there is one or more projected parts. When a plurality of projected seal parts are provided, the projected seal parts are preferably arranged at even intervals for applying balanced stress in peeling.

According to the present invention, the first seal part keeps the sealing performance of the packaging body, while the projected part of the second seal part serves as a trigger of the peeling in peeling off the cover and provides smooth peeling. Since the strong heat-sealing is provided, the sealing performance can be enhanced. That is to say, when the cover is peeled off from the container body, at least the inner most layer of the flange is lifted, and the entire circumference of the innermost layer of the heat-sealed part is peeled off. Thus, since the problem in sealing performance caused by an arrangement where the heating is performed for sterilization of the contents after forming the container body and the notches and the heat-sealing is provided out of the area between the notches does not occur, and thus the problem does not have to be solved with excessive adhesive strength of the first seal part. Therefore, the easy-open performance is not degraded, and the sealing performance and the easy-open performance can be achieved at the same time.

By providing the second seal part, the second seal part serves as the trigger of the peeling in peeling off the cover. Thus, unlike the conventional arrangement, the problem where, in forming the dent for peeling, a dent is formed on a position other than the predetermined position, causing the peeling to start from the outer circumferential end of the heat-sealed part instead of from the outer notch does not occur, so that the easy-open packaging body with consistent quality can be provided.

In the easy-open packaging body of the present invention, the tip end of the projected part may be positioned on an inner side of the outer notch as long as the distance is equal to or less than 0.5 mm.

With the arrangement, by positioning the tip end of the projected part on the inner side relative to the outer notch, resin used for forming the projected seal part will not flow into the outer notch, so that the peeling of the cover will not be affected.

In the easy-open packaging body according to the present invention, it is preferable that an inner circumferential side of the first seal part and the inner notch are spaced apart. The spaced distance is approximately 0.2 to 5 mm.

With the arrangement, since the inner circumferential side of the first seal part and the inner notch are spaced apart, if the pressure inside the packaging body increases, the stress concentrates on the inner circumferential side of the first seal part, so that the peeling from inner side does not occur even with the arrangement in which at least the innermost layer of the flange of the container is easily peeled off from the notch.

In the easy-open packaging body according to the present invention, it is preferable that the flange has a bent part formed by bending an outer circumferential end of the flange.

The bent part includes a so-called skirt type with the outer circumferential end of the flange merely being bent, a so-called curl type with the outer circumferential end being extended vertically downward and bent to have substantially C-shaped or semicircular cross section, and the like.

With the arrangement, since the flange has the bent part formed by bending the outer circumferential end thereof, rigidity of the container is enhanced, thus flexibly meeting the size increase, shape change and thickness reduction of the container.

In the easy-open packaging body according to the present invention, it is preferable that the innermost layer is made of polypropylene resin, and the thickness of the innermost layer is 40 to 100 μm.

If the thickness is smaller than 40 μm, the pressure resistance might be degraded. If the thickness exceeds 100 μm, it becomes difficult to form the projected seal part.

In the easy-open packaging body according to the present invention, it is preferable that, when the innermost layer of the container body is peeled off with the cover in opening, the innermost layer is peeled off by layer peeling generated between the innermost layer and an adjacent layer adjacent to the innermost layer or cohesive peeling generated within the adjacent layer.

With the arrangement, through the layer peeling generated between the innermost layer and the adjacent layer adjacent to the innermost layer or the cohesive peeling generated within the adjacent layer, the cover is not peeled off from the innermost layer, which allows the sealing strength between the cover and the innermost layer to be increased, so that the packaging body can be easily opened without affecting the sealing performance.

According to another aspect of the present invention, a manufacturing method of an easy-open packaging body formed by molding a multilayer sheet and including a container body including an opening and a flange formed on a circumference of the opening and a cover that is heat-sealed to the flange to close the opening, the cover having an open trigger on an outer circumference of the cover, in which, when the cover is peeled off from the open trigger, at least an innermost layer of the container body which is heat-sealed on the flange is peeled off with the cover in opening includes: a notch forming step for forming an inner notch and an outer notch each enclosing the opening respectively on an inner circumferential side and outer circumferential side of the flange; a contents filling step for filling the container body with contents; a first heat-sealing step for forming a first seal part having a predetermined width between the inner notch and the outer notch to enclose the opening, and a second heat-sealing step for forming a second seal part having a width narrower than that of the first seal part and formed within an area of the first seal part to enclose the opening along the first seal part, the second seal part being projected outward relative to the other part on a position corresponding to the open trigger.

According to the present invention, the first seal part keeps sealing performance of the packaging body, while the projected part of the second seal part serves as a trigger of the peeling in peeling off the cover and provides smooth peeling. Since the strong heat-sealing is provided, the sealing performance can be enhanced. That is to say, when the cover is peeled off from the container body, at least the inner most layer of the flange is lifted, and the entire circumference of the innermost layer of the heat-sealed part is peeled off.

Therefore, since the problem in sealing performance caused by an arrangement where the heating is performed for sterilization of the contents after forming the container body and the notches and the heat-sealing is provided out of the area between the notches does not occur, and thus the problem does not have to be solved with excessive adhesive strength of the first seal part. Therefore, the easy-open performance is not degraded, and the sealing performance and the easy-open performance can be achieved at the same time.

Thus, by providing the second seal part that serves as the trigger of the peeling in peeling off the cover, unlike the conventional arrangement, a problem where, in forming the dent for peeling, a dent is formed on a position other than the predetermined position, causing the peeling to start from the outer circumferential end of the heat-sealed part instead of from the outer notch does not occur, so that the easy-open packaging body with consistent quality can be provided.

In the manufacturing method of the easy-open packaging body according to the present invention, it is preferable that the second heat-sealing step is conducted under a condition with temperature and pressure higher than those of the first heat-sealing step.

With the arrangement, by conducting the second heat-sealing step under the condition having temperature and pressure as than those of the first heat-sealing step, a dent is not generated on a position other than the predetermined position when the heat-sealing is performed, and thus the peeling does not start from the outer edge of the heat-sealed part, so that the packaging body with high reliability can be provided.

In the manufacturing method of the easy-open packaging body according to the present invention, it is preferable that heat-sealing temperature in the second heat-sealing step is higher than that of the first heat-sealing step by 5° C. or more.

If the heat-sealing temperature in the second heat-sealing step is not higher than that of the first heat-sealing step by 5° C. or more, the peeling cannot be started and further smoothness in peeling is degraded. Furthermore, the heat-sealing strength is lowered, which might cause a problem in sealing performance.

BEST MODE FOR CARRYING OUT THE INVENTION

An embodiment of the present invention will be described below with reference to the attached drawings.

Figure 1:
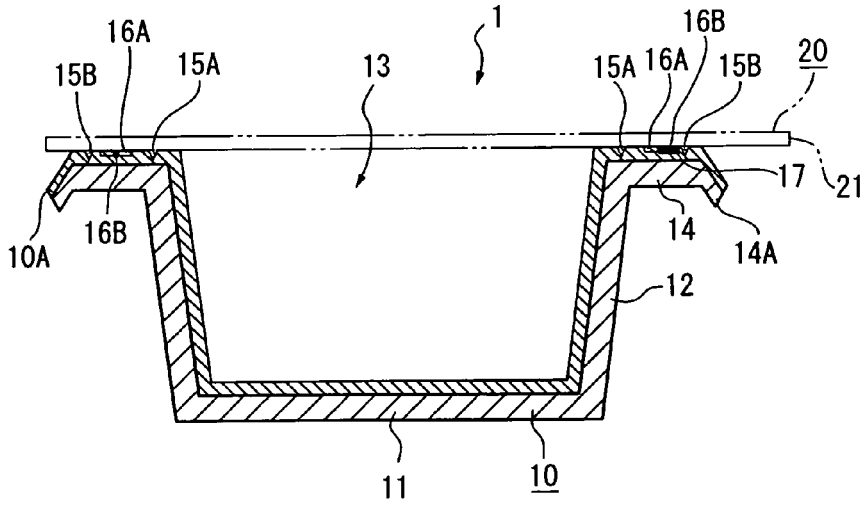
FIG. 1 is a cross section showing an easy-open packaging body according to a first embodiment of the present invention.

FIGS. 1 (side view), 2 (top view) and 3 (fragmentary sectional view of FIG. 1) show an easy-open packaging body 1 according to the embodiment of the present invention.

The easy-open packaging body 1 includes a resin-made container body 10 formed by molding a multilayer sheet and a circular cover 20 with an opening tab.

Although not shown, the cover 20 is formed by laminating three layers of cast polypropylene, ethylene vinyl alcohol resin and nylon, in order starting from the side of the container body 10, the cover 20 including a semicircular tab 21 as an open trigger. The outer diameter of the cover 20 is greater than that of a flange 14. The tab 21 is big enough to be pinched for opening.

The container body 10 includes a circular bottom side 11, a cylindrical lateral side 12 being upright from and integrated with the bottom side 11, a circular opening 13 on a top side and the ringed flange 14 extending outward from the circumference of the opening 13, which are integrated to form the container body 10.

Figure 3:
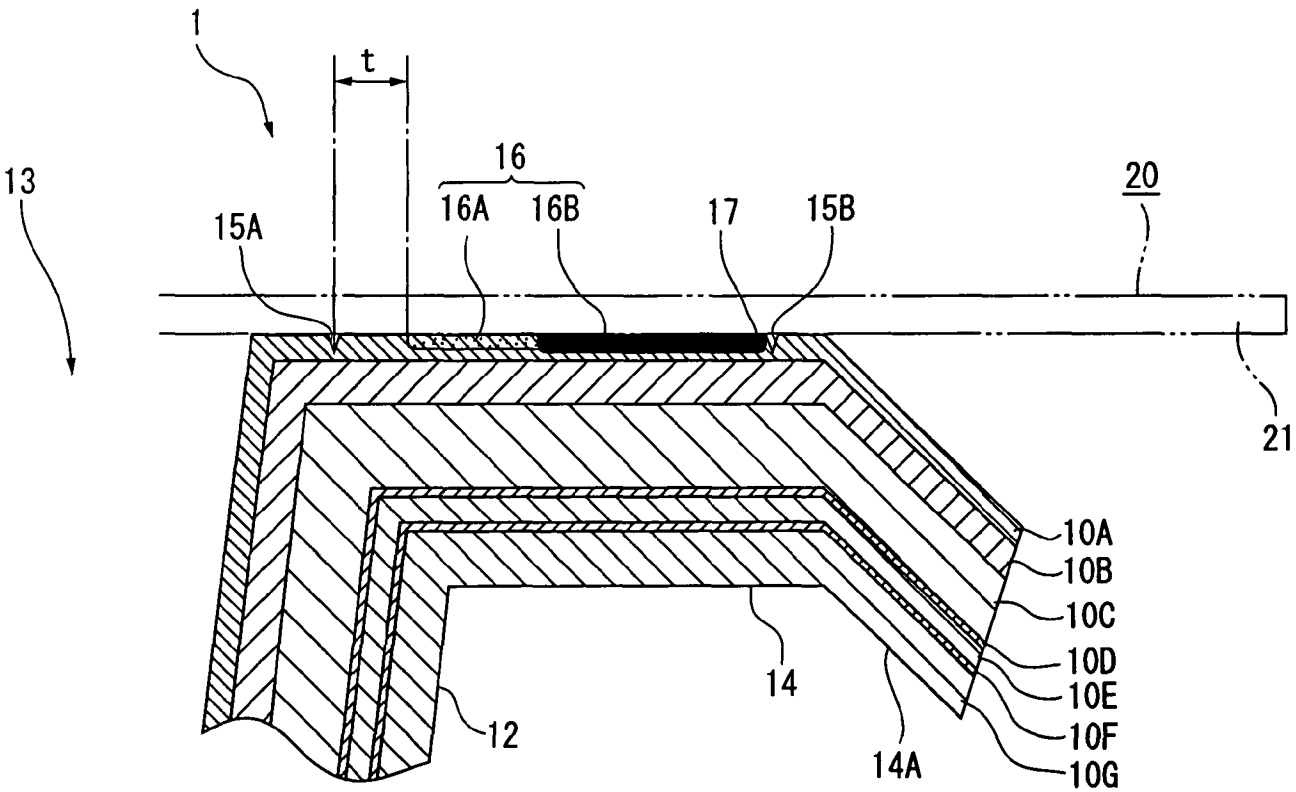
FIG. 3 is a cross section showing a flange of the embodiment shown in FIG. 1 in an enlarged manner.

As shown in detail in FIG. 3, layers of the container body 10 include a first layer 10A (the innermost layer), a second layer 10B, a third layer 10C, a fourth layer 10D, a fifth layer 10E, a sixth layer 10F and a seventh layer 10G, in order starting from the inner side. Each of the layers may be made of various resins such as polyolefin resin, polyethylene resin, polypropylene resin, ethylene vinyl alcohol resin and adhesive resin.

The first layer 10A is made of polyethylene resin or polypropylene resin with thickness of 40 to 100 μm.

If the thickness is smaller than 40 μm, the pressure resistance might be lowered. If the thickness exceeds 100 μm, it becomes difficult to form a projected seal part 17 (described later).

The flange 14 has a bent part 14A formed by bending the outer circumferential end of the flange 14. The bent part 14A has a so-called skirt shape with the outer circumferential end merely being bent downward by 45°.

On the top side of the flange 14, inner and outer notches 15A and 15B each enclosing the opening 13 are formed respectively on the inner and outer circumferential sides of the flange 14, and a heat-seal part 16 is concentrically formed on an area between the inner and outer notches 15A and 15B.

The inner and outer notches 15A and 15B have V-shaped cross section being gradually narrowed in depth direction, the depth of which is substantially equal to the thickness of the first layer 10A of the container body 10.

The cross section of the inner and outer notches 15A and 15B may also be U-shape, linear, semicircle arc and the like. The depth of the inner and outer notches 15A and 15B may be any depth as long as the first layer 10A of the container body 10 can be easily cut when the cover 20 is peeled off, which is preferably be greater as compared to the thickness of the first layer 10A.

The heat-seal part 16 is welded on a back side of the cover 20, which includes a ringed first seal part 16A enclosing the opening 13 and having a predetermined width and a ringed second seal part 16B formed within an area of the first seal part 16A to enclose the opening 13 along the first seal part 16A, the second seal part 16B being narrower than the first seal part 16A.

The inner circumferential side of the first seal part 16A and the inner notch 15A are spaced apart (shown by t in FIG. 3).

The second seal part 16B is formed along the central part of the first seal part 16A in the width direction, the width of which is narrower than that of the first seal part 16A.

The second seal part 16B includes the projected seal part 17 that is projected outward relative to the other part on a position corresponding to the tab 21 as the open trigger.

Figure 2:
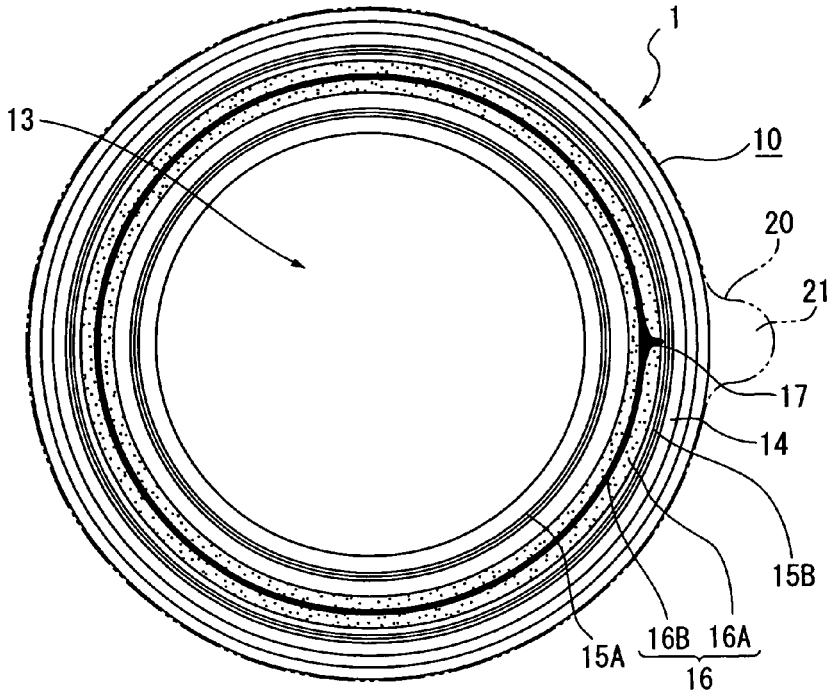
FIG. 2 is a plan view showing the easy-open packaging body of the embodiment shown in FIG. 1.

As shown in FIG. 2, the projected seal part 17 has a substantially triangular shape in plan view, the resin of the projected seal part 17 being continuously connected to the resin of the second seal part 16B.

The easy-open packaging body 1 formed as described above is manufactured as follows.

A resin-made multilayer sheet including multilayer (seven layers in the present embodiment), which is molded in advance by T-die extrusion, lamination or the like is prestretched using a plug in a cavity having a shape corresponding to the profile of the container, and then the container body 10 is manufactured by a plug assist molding where a container is molded by air-pressure molding or vacuum molding (container molding step).

Then, by pressing a stamping die having ringed blades onto the top side of the flange 14, the inner and outer notches 15A and 15B each enclosing the opening 13 are formed respectively on the inner and outer circumferential sides of the flange 14 (notch forming step).

After the notch forming step, the container body 10 is filled with contents (contents filling step), and the film cover 20 is welded onto the flange 14 using a heat-seal device. The welded part in the above step becomes the heat-seal part 16.

Although not shown, the heat-seal device used herein is a widely-used one, which includes a seal bucket for receiving the container body 10, a cover feeder for feeding the film cover 20, and a seal ring moving vertically for sealing the cover 20 and the flange 14 of the container body 10.

First, the seal ring corresponding to the shape of the first seal part 16A is pressed onto the top side of the flange 14 via the cover 20.

The first seal part 16A is formed in such a manner that the inner circumferential side of the first seal part 16A and the inner notch 15A are spaced apart with a distance (t in FIG. 3) between the inner circumferential side of the first seal part 16A and the inner notch 15A being 0.2 to 5.0 mm (first heat-sealing step). The distance described above is required since the stress concentrates on the inner side of the ringed seal part.

Next, a seal ring corresponding to the shape of the second seal part 16B having the projected seal part 17 projected toward the outer circumferential side is pressed onto the top side of the flange 14 via the cover 20, and the second seal part 16B having narrower width than the first seal part 16A and having the projected seal part 17 are formed within the area of the first seal part 16A to enclose the opening 13 along the first seal part 16A (second heat-sealing step).

The second heat-sealing step is conducted under the condition having temperature and pressure higher than that of the first heat-sealing step.

The heat-sealing temperature in the second heat-sealing step is higher than that of the first heat-sealing step by 5° C. or more.

If the heat-sealing temperature in the second heat-sealing step is not higher than that of the first heat-sealing step by 5° C. or more, the peeling cannot be started and further smoothness in peeling is degraded. In addition, the heat-sealing strength is lowered, which might cause a problem in sealing performance.

Referring to FIG. 3, first, the tab 21 is gripped to peel off the cover 20 to open the easy-open packaging body 1.

The second seal part 16B having the projected seal part 17 serves as a trigger of the peeling when the cover 20 is peeled off. When the cover 20 is peeled off from the container body 10, the first layer 10A of the flange 14 is lifted, and the entire circumference of the first layer 10A of the heat-sealed part is peeled off. After the peeling is started, the first layer 10A is cut at the outer notch 15B, which causes layer peeling between the first layer 10A and the second layer 10B.

When the layer peeling between the first layer 10A and the second layer 10B reaches the inner notch 15A, the first layer 10A is cut at the outer notch 15B (Translator's comment: correctly, inner notch 15A). At this time, the first layer 10A on a part between the inner and outer notches 15A and 15B is adhered to the cover 20.

The present embodiment described above provides advantages as follows.

(1) The first seal part 16A keeps sealing performance of the easy-open packaging body 1, while the second seal part 16B having the projected seal part 17 (projected part) serves as a trigger of the peeling in peeling off the cover 20 and provides smooth peeling. Since the strong heat-sealing is provided, the sealing performance can be enhanced. When the cover 20 is peeled off from the container body 10, at least the first layer 10A of the flange 14 is lifted, and the entire circumference of the first layer 10A of the heat-seal part 16 is peeled off. Therefore, since the problem in sealing performance caused by an arrangement where the heating is performed for sterilization of the contents after forming the container body 10 and the inner and outer notches 15A and 15B and the heat-sealing is provided out of the area between the inner and outer notches 15A and 15B does not occur, and thus the problem does not have to be solved with excessive adhesive strength of the first seal part 16A. Accordingly, the easy-open performance is not degraded, and the sealing performance and the easy-open performance can be achieved at the same time By providing the second seal part 16B, the second seal part 16B serves as the trigger in peeling off the cover 20. Thus unlike the conventional arrangement, a problem where, in forming the dent for peeling, a dent not formed on a position other than the predetermined position, causing the peeling to start from the outer circumferential end of the heat-sealed part instead of from the outer notch does not occur, so that the easy-open packaging body 1 with consistent quality can be provided.

(2) When the tip end of the projected seal part 17 is positioned on the inner side relative to the outer notch 15B, resin for forming the projected seal part 17 does not flow into the outer notch 15B, so that the peeling of the cover 20 is not impeded.

(3) Since the inner circumferential side of the first seal part 16A and the inner notch 15A are spaced apart by the distance t, even when the pressure inside the packaging body increases, the stress concentrates on the inner circumferential side of the first seal part 16A, so that the peeling from the inner side does not occur even with the arrangement where at least the innermost layer of the flange 14 of the container is easily peeled off from the notch.

(4) Since the flange 14 has the bent part 14A formed by bending the outer circumferential end thereof, rigidity of the container body 10 is enhanced, thus flexibly meeting the size increase, shape change and thickness reduction of the container.

(5) Due to the layer peeling between the first layer 10A and the adjacent second layer 10B adjacent to the first layer 10A, the cover 20 is not peeled off from the first layer 10A, which allows the sealing strength between the cover 20 and the first layer 10A to be increased, so that the easy-open packaging body 1 can be opened easily without affecting the sealing performance.

(6) By performing the second heat-sealing step under the condition having temperature and pressure higher than those of the first heat-sealing step, the dent generated on a position other than the specific position is not formed in heat-sealing, and thus the peeling does not start from the outer circumferential end of the heat-seal part 16, so that the packaging body with high reliability can be provided.

The scope of the present invention is not restricted to the embodiment described above, but includes modifications and improvements as long as an object of the present invention can be achieved.

For instance, although the shape of the projected seal part 17 is triangular in the above embodiment, it may be trapezoidal, quadrangular, semicircular and the like.

The shape and size of the tip end and the base end of the projected seal part 17 are not limited specifically either, but the base end is preferably rounded in the outer circumferential direction.

Although one projected seal part 17 is formed in the above embodiment, the number is not limited as long as there is one or more projected seal part 17. When there are a plurality of projected seal parts, the projected seal parts are preferably arranged at even intervals for applying balanced stress in peeling.

Although the bent part 14A is a so-called skirt type with the outer circumferential end of the flange merely being bent in the above embodiment, a so-called curl type with the outer circumferential end being extended vertically downward and bent to have substantially C-shaped cross section and the like may also be employed.

When the first layer 10A as the innermost layer of the container body 10 is peeled off with the cover 20 in opening, although the layer peeling is generated between the first layer 10A and the second layer 10B as the adjacent layer adjacent to the first layer 10A in the above embodiment, the cohesive peeling may be generated within the second layer 10B.

Although the container body 10 is formed by molding the multilayer sheet having seven layers, the multilayer sheet may have three to six layers or eight or more layers as long as there are two or more layers.

Although the cover 20 is formed by three layers in the above embodiment, the cover 20 may be formed by a single layer, two layers or four or more layers.

Although the cover 20 is flat shaped in the above embodiment, the cover 20 may be stepped.

Specific structure and shape of the components in the present invention may be designed in any manner as long as an object of the present invention can be achieved.

The present invention will further be described below with reference to examples and comparative examples.

Example 1

Multilayer Sheet

Multilayer sheet having seven layers was molded by coextrusion molding using resins described below as raw resins of the multilayer sheet used for molding the container body 10.

[1] First Layer 10A (Innermost Layer)

[1-1] Raw resin: polypropylene (F734 manufactured by Idemitsu Petrochemical Co., Ltd.)

[1-2] Layer thickness: 70 μm

[2] Second Layer 10B (Adjacent Layer)

[2-1] Raw resin: 60 wt % of polypropylene (E-105GM manufactured by Idemitsu Petrochemical Co., Ltd.) and 40 wt % of low density polyethylene (LDPE-fz-038 manufactured by Mitsubishi Corporation.)

[2-2] Layer thickness: 200 μm

[3] Third Layer 10C (Base Material Layer)

[3-1] Raw resin: polypropylene (E-170GM manufactured by Idemitsu Petrochemical Co., Ltd.)

[3-2] Layer thickness: 300 μm

[4] Fourth Layer 10D

[4-1] Raw resin: modified polyolefin adhesive resin (ADMER QB-550 manufactured by Mitsui Chemicals, Inc.)

[4-2] Layer thickness: 10 μm

[5] Fifth Layer 10E (Barrier Layer)

[5-1] ethylene vinyl alcohol resin (EVAL manufactured by KURARAY CO., LTD.)

[5-2] Layer thickness: 40 μm

[6] Sixth Layer 10F

[6-1] Raw resin: modified polyolefin adhesive resin (ADMER QB-550 manufactured by Mitsui Chemicals, Inc.)

[6-2] Layer thickness: 10 μm

[7] Seventh Layer 10G (Container Outer Layer)

[7-1] Raw resin: polypropylene (E-170 GM manufactured by Idemitsu Petrochemical Co., Ltd.)

[7-2] Layer thickness: 300 μm (Container Body)

The above-described multilayer sheet having seven layers was molded into the container body having the size as shown below by plug assist air-pressure molding.

Inner diameter of opening: 140 mm

Diameter of bottom side: 80 mm

Height: 40 mm

Width of flange: 9 mm

Length of bent part: 3 mm (Flange)

The inner and outer notches were formed on the flange using ringed heated blades with the distance between the inner and outer notches being 5 mm. The depths of the inner and outer notches were set to be substantially equal to the thickness of the first layer.

The cover was formed by laminating three layers of cast polypropylene, ethylene vinyl alcohol resin and nylon, in order starting from the side of the container body. The thickness of the cover was 90 μm.

(First Seal Part)

The first seal part was formed by a seal ring of 2.5 mm, the first seal part being spaced apart from the inner notch by 1.75 mm. The sealing condition was as follows; temperature 180° C., pressure 15 MPa/container, and time 1.2 seconds.

(Second Seal Part and Projected Seal Part)

The second seal part was provided on the central part of the first seal part in the width direction with the sealing width of 1.5 mm. When the second seal part was formed, the projected seal part was integrally formed. Two projected seal parts were formed on the two positions of the second seal part. The projected seal parts were formed in substantially triangular with bottom portion of 6 mm and height of 1 mm, the bottom portion being rounded.

That is, the sealing was integrally provided using a seal ring corresponding to the second seal part and the projected seal part. The sealing condition was as follows; temperature 190° C., pressure 15 MPa/container, and time 1.2 seconds.

Example 2

Example 2 differed from Example 1 in that the thickness of the first layer 10A (innermost layer) was 100 μm instead of 70 μm.

Example 3

Example 3 differed from Example 1 in that the thickness of the first layer 10A (innermost layer) was 40 μm instead of 70 μm.

Comparative Example 1

Comparative example 1 differed from Example 1 in that the container was heat-sealed only by the first seal part without forming the second seal part and the projected seal part. That is, the thickness of the first layer 10A (innermost layer) is 70 μm.

Comparative Example 2

Comparative example 2 differed from Example 2 in that the container was heat-sealed only by the first seal part without forming the second seal part and the projected seal part. That is, the thickness of the first layer 10A (innermost layer) is 100 μm.

Comparative Example 3

Comparative example 3 differed from Example 3 in that the container was heat-sealed only by the first seal part without forming the second seal part and the projected seal part. That is, the thickness of the first layer 10A (innermost layer) is 40 μm.

Comparative Example 4

Comparative example 4 differed from Example 1 in that the container was heat-sealed only by the first seal part and a triangular projected part projected toward the outer circumferential side from the first seal part without forming the second seal part. That is, the thickness of the first layer 10A (innermost layer) is 70 μm.

Comparative Example 5

Comparative example 5 differed from Example 2 in that the container was heat-sealed only by the first seal part and a triangular projected part toward the outer circumferential side from the first seal part without forming the second seal part. That is, the thickness of the first layer 10A (innermost layer) is 100 μm.

Comparative Example 6

Comparative example 6 differed from Example 3 in that the container was heat-sealed only by the first seal part and a triangular projected part projected toward the outer circumferential side from the first seal part without forming the second seal part. That is, the thickness of the first layer 10A (innermost layer) is 40 μm.

[Evaluation Method and Evaluation Result]

(Observation of Opening Condition and Result)

After opening the cover of the packaging body obtained by Examples 1 to 3 and Comparative examples 1 to 6, the opening conditions were observed.

In Example 1, 100% of the heat-seal part on the cover and the flange was able to be opened easily.

In Example 2, 70% of the heat-seal part on the cover and the flange was able to be opened easily.

In Example 3, 100% of the heat-seal part on the cover and the flange was able to be opened easily. When the cover of Example 3 was peeled off, a part of the first layer (innermost layer) was broken.

In Comparative examples 1 to 3, when the first seal part was displaced toward either of the inner or outer notch even by 0.1 mm, the cover was not able to be opened.

In Comparative example 4 to 6, only 50% of the heat-seal part on the cover and the flange was able to be opened stably.

(Quantitative Evaluation of Sealing Performance and Evaluation Result)

A proximate part of the projected seal part of the packaging body of Example 1 was cut into a piece of 15 mm width to obtain a sample. Tensile strength of the sample (15 mm width) was measured when the sample was peeled at peeling speed of 50 mm/min and at peeling angle of 180° using a tension tester. The tensile strength was 8 N/15 mm width.

When the peeling of the cover and a portion corresponding to the inner side of the container body was measured in the same manner, the tensile strength was 30 N/15 mm width.

Further, the pressurized air was introduced into the packaging body of Example 1 to measure the pressure at the time the packaging body was blown out. The pressure was 0.05 MPa.

INDUSTRIAL APPLICABILITY

The present invention is applicable to an easy-open packaging body that can be easily opened by peeling off a cover, especially to a container or a packaging body filled with contents such as food.

The invention claimed is:

1. A sealed container, comprising:

a container body molded from a multilayer sheet; and a cover heat sealed to the container body;

wherein:

the container body comprises a receptacle for holding contents having an opening, and a flange provided at a circumference of the opening and extending radially outward from the opening;

the cover comprises a tab extending radially outward from a remainder of the cover;

an innermost layer of the multilayer sheet forming the container body forms an interior surface of the receptacle and an upper surface of the flange;

the flange comprises an inner notch and an outer notch;

the inner notch extends around the circumference of the opening and protrudes at least partially through the innermost layer of the container body;

the outer notch extends around the circumference of the opening and protrudes at least partially through the innermost layer of the container body;

the inner notch is closer to the opening of the container body than the outer notch;

a section of the innermost layer of the container body provided on the flange between the inner notch and the outer notch is adhered to the cover;

the section of the innermost layer is adhered to the cover by:

placing the cover in contact with the upper surface of the flange;

pressing a first heat seal ring onto the flange via the cover in the section between the inner notch and the outer notch and removing the first heat seal ring; and pressing a second heat seal ring onto the flange via the cover in the section between the inner notch and the outer notch and removing the second heat seal ring;

wherein:

the second heat seal ring has a narrower profile than the first heat seal ring;

the second heat seal ring comprises a projected part extending radially outwardly from a remainder of the second heat seal ring;

the second heat seal ring is pressed onto a portion of the flange wholly within a portion of the flange onto which the first heat seal ring was previously pressed; and the projected part of the second heat seal is located in a vicinity of the tab of the cover when the second heat seal ring is pressed onto the flange; and when the cover is removed from the container body by pulling the tab, at least a portion of the section of the innermost layer of the container body provided on the flange between the inner notch and the outer notch is removed from the container body with the cover.

2. The sealed container of claim 1, wherein the innermost layer of the multilayer sheet comprises polypropylene.

3. The sealed container of claim 1, wherein the flange comprises a bent part formed by bending an outer circumferential end of the flange.

4. The sealed container of claim 1, wherein the second heat seal ring is pressed onto the flange at a temperature and a pressure that exceed a temperature and a pressure at which the first heat seal ring is pressed onto the flange.

5. The sealed container of claim 1, wherein the second heat seal ring is pressed onto the flange at a temperature that exceeds a temperature at which the first heat seal ring is pressed onto the flange by 5° C. or more.

6. A method for preparing a sealed container, comprising:

filling a container body molded from a multilayer sheet with contents;

placing a cover on the container body;

performing a first heat sealing step to adhere the cover to the container body; and performing a second heat sealing step to adhere the cover to the container body after the first heat sealing step is complete;

wherein:

the container body comprises a receptacle for holding the contents having an opening, and a flange provided at a circumference of the opening and extending radially outward from the opening;

the cover comprises a tab extending radially outward from a remainder of the cover;

an innermost layer of the multilayer sheet forming the container body forms an interior surface of the receptacle and an upper surface of the flange;

the flange comprises an inner notch and an outer notch;

the inner notch extends around the circumference of the opening and protrudes at least partially through the innermost layer of the container body;

the outer notch extends around the circumference of the opening and protrudes at least partially through the innermost layer of the container body;

the inner notch is closer to the opening of the container body than the outer notch;

performing the first heat sealing step comprises pressing a first heat seal ring onto the flange via the cover in a section of the innermost layer of the container body provided on the flange between the inner notch and the outer notch and removing the first heat seal ring;

performing the second heat sealing step comprises pressing a second heat seal ring onto the flange via the cover in the area between the inner notch and the outer notch and removing the second heat seal ring;

the second heat seal ring has a narrower profile than the first heat seal ring;

the second heat seal ring comprises a projected part extending radially outwardly from a remainder of the second heat seal ring;

the second heat seal ring is pressed onto a portion of the flange wholly within a portion of the flange onto which the first heat seal ring was previously pressed; and the projected part of the second heat seal is located in a vicinity of the tab of the cover when the second heat seal ring is pressed onto the flange.

7. The method of claim 6, wherein the innermost layer of the multilayer sheet comprises polypropylene.

8. The method of claim 6, wherein the flange comprises a bent part formed by bending an outer circumferential end of the flange.

9. The method of claim 6, wherein the second heat seal ring is pressed onto the flange at a temperature and a pressure that exceed a temperature and a pressure at which the first heat seal ring is pressed onto the flange.

10. The method of claim 6, wherein the second heat seal ring is pressed onto the flange at a temperature that exceeds a temperature at which the first heat seal ring is pressed onto the flange by 5° C. or more.

11. A sealed container, comprising:

a container body molded from a multilayer sheet; and a cover heat sealed to the container body;

wherein:

the container body comprises a receptacle for holding contents having an opening, and a flange provided at a circumference of the opening and extending radially outward from the opening;

the cover comprises a tab extending radially outward from a remainder of the cover;

an innermost layer of the multilayer sheet forming the container body forms an interior surface of the receptacle and an upper surface of the flange;

the flange comprises an inner notch and an outer notch;

the inner notch extends around the circumference of the opening and protrudes at least partially through the innermost layer of the container body;

the outer notch extends around the circumference of the opening and protrudes at least partially through the innermost layer of the container body;

the inner notch is closer to the opening of the container body than the outer notch;

a section of the innermost layer of the container body provided on the flange between the inner notch and the outer notch is adhered to the cover;

the section of the innermost layer includes a first portion having a first thickness and an a second portion having a second thickness;

the second thickness is smaller than the first thickness;

the second portion has a narrower profile than the first portion;

the second portion includes a projected part extending radially outwardly from a remainder of the second portion;

the second portion is wholly within the first portion;

the projected part of the second portion is located in a vicinity of the tab of the cover; and when the cover is removed from the container body by pulling the tab, at least a portion of the section of the innermost layer of the container body provided on the flange between the inner notch and the outer notch is removed from the container body with the cover.

12. The sealed container of claim 11, wherein the innermost layer of the multilayer sheet comprises polypropylene.

13. The sealed container of claim 11, wherein the flange comprises a bent part formed by bending an outer circumferential end of the flange.

* * * * *